US010537753B2

(12) United States Patent
Dehmke et al.

(10) Patent No.: US 10,537,753 B2
(45) Date of Patent: Jan. 21, 2020

(54) BLOWER FILTER SYSTEM

(71) Applicant: Dräger Safety AG & Co. KGaA, Lübeck (DE)

(72) Inventors: Mathias Dehmke, Lübeck (DE); Björn Ehler, Lübeck (DE); Thomas Pernot, Lübeck (DE); Achim Volmer, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 880 days.

(21) Appl. No.: 14/922,501

(22) Filed: Oct. 26, 2015

(65) Prior Publication Data

US 2016/0114195 A1 Apr. 28, 2016

(30) Foreign Application Priority Data

Oct. 27, 2014 (DE) ..... 10 2014 015 769

(51) Int. Cl.
*A62B 9/00* (2006.01)
*A62B 7/10* (2006.01)

(52) U.S. Cl.
CPC ..... *A62B 9/006* (2013.01); *A62B 7/10* (2013.01)

(58) Field of Classification Search
CPC .. A62B 9/00; A62B 9/006; A62B 7/00; A62B 7/10
USPC ..... 181/224, 229
See application file for complete search history.

(56) References Cited

U.S. PATENT DOCUMENTS 5,825,718 A * 10/1998 Ueki ..... H04B 11/00 367/132
5,906,203 A 5/1999 Klockseth et al.
7,506,626 B2 * 3/2009 Sasaki ..... F02M 35/1294 123/184.53

(Continued)

FOREIGN PATENT DOCUMENTS

AT 46 204 B 1/1911
CN 184 3525 A 10/2006

(Continued)

OTHER PUBLICATIONS

Fletcher, H. and Munson, W. "Loudness, Its Definition, Measurement, and Calculation". Oct. 1933. The Journal of the Acoustical Society of America, vol. 5.*

(Continued)

*Primary Examiner* — Valerie L Woodward
*Assistant Examiner* — Jacqueline M Pinderski
(74) *Attorney, Agent, or Firm* — McGlew and Tuttle, P.C.

(57) ABSTRACT

A blower filter system (2) has a blower filter device (4) with a housing (56), an air inlet (50), an air outlet (52) and an air duct (54) extending between the air inlet (50) and the air outlet (52) in the housing (56). A blower (6), associated with the air duct (54), delivers air from the air inlet (50) to the air outlet (52). An air filter (16) and a carrying system (18) can be connected to the blower filter device (4). A tube (24) extends from the air outlet (52) to a breathing mask (20). A sound emission unit (64) is associated with the blower filter device (4). A wall section (58) of the air duct (54) is formed by an acoustic membrane (60) for coupling sound into the air duct (54). The sound emission unit (64) is arranged in the housing (56) of the blower filter device (4).

19 Claims, 2 Drawing Sheets

(56) References Cited

U.S. PATENT DOCUMENTS

| | | | | |
|---|---|---|---|---|
| 2004/0170287 | A1* | 9/2004 | Biwa | G10K 11/22 381/71.5 |
| 2006/0154594 | A1* | 7/2006 | Ozil | A41D 13/0025 454/251 |
| 2009/0266361 | A1* | 10/2009 | Bilger | A62B 7/10 128/204.21 |
| 2010/0329476 | A1* | 12/2010 | Khami | F02M 35/1272 381/86 |
| 2013/0070564 | A1* | 3/2013 | Prokop | A01M 29/16 367/139 |

FOREIGN PATENT DOCUMENTS

| | | | |
|---|---|---|---|
| CN | 102 488 984 | A | 6/2012 |
| CN | 102 665 822 | A | 9/2012 |
| CN | 103 656 898 | A | 3/2014 |
| DE | 253 943 | A1 | 2/1988 |
| JP | 2005-184 037 | A | 7/2005 |

OTHER PUBLICATIONS

Dan. "How to Calcualte the Natural Vibration Frequency of a Steel Tube". Dec. 5, 2013. The Chicago Curve.*

* cited by examiner

BLOWER FILTER SYSTEM

CROSS REFERENCE TO RELATED APPLICATIONS

This application claims the benefit of priority under 35 U.S.C. § 119 of German Patent Application 10 2014 015 769.5 filed Oct. 27, 2014, the entire contents of which are incorporated herein by reference.

FIELD OF THE INVENTION

The present invention pertains to a blower filter system having a blower filter device with a housing with an air inlet, an air outlet and an air duct extending between the air inlet and the air outlet in the housing; a blower associated with the air duct for delivering air from the air inlet to the air outlet, an air filter, a carrying system, which can be connected to the blower filter device, a breathing mask, a tube, which extends from the air outlet to the breathing mask, and a sound emission unit associated with the blower filter device.

BACKGROUND OF THE INVENTION

Blower filter systems are known, in principle, from practice. Blower filter systems are usually used for light to medium breathing protection. They support the user of breathing masks, which are also called gas masks, by a breathing resistance being reduced, contrary to conventional breathing masks. Breathing masks are defined as breathing masks as such, breathing hoods and/or other devices, which are designed to protect a head part and/or to supply air to the face of a user. A reduction of the breathing resistance makes possible a long fatigue-free use of the breathing mask.

The blower filter device is one of the components of a blower filter system. An outer limitation and/or wall of the blower filter device is preferably formed by a housing of the blower filter device. In order for the air stream caused by the blower to be guided from an air inlet of the blower filter device to an air outlet of the blower filter device, the blower filter device has an air duct. The air duct is consequently used to direct and/or guide air in the blower filter device. In addition, at least one pneumatic unit, especially the blower filter housing of the blower, may be received or integrated by the air duct. The air duct extends from the air inlet of the blower filter device to the air outlet of the blower filter device. The end-face openings of the air duct are consequently formed by the air inlet and the air outlet. The air duct is preferably made airtight with the exception of the air inlet and the air outlet, which prevents air from escaping the air duct or entering the air duct in an uncontrolled manner.

The air inlet and the air outlet preferably form openings in the housing of the blower filter device. Ambient air can thus be drawn in by the blower filter device through the air inlet. The air delivered by the blower can be blown out and/or pumped out through the air outlet. The blower has, for example, a motor, a fan impeller driven by the motor and a corresponding blower housing, especially a spiral housing. A volume flow of air is consequently generated with the blower.

The energy necessary for the blower and for the volume flow of air may be made available by an electric battery. This battery may be detachably connected to a battery mount of the blower filter device. The battery and the battery mount may have connection elements corresponding to one another for this, with which the aforementioned connection can be established. This connection may be a snap connection or locking connection. Other types of connection, which are likewise detachable, are also possible.

To guarantee that the volume of air flow provided by the blower will not damage the user, the blower filter system may have an air filter. The air drawn in by the blower can thus be drawn in through the air filter, which is preferably connected to the filter mount of the blower filter device, especially in a detachable manner, in order to achieve a corresponding protective effect. The air filter may be arranged, in principle, at the air inlet, at the air outlet or at another suitable location in the path of the air from the air inlet to the breathing mask. Analogously to the connection explained above, the air filter and a filter mount, especially of the blower filter device, may have corresponding connection elements in order to establish a detachable connection. This connection may be a snap connection or a locking connection. Air filters are likewise known from the state of the art and may have different designs. The air filters differ especially in respect to the substances to be filtered. Air filters can be distinguished, in principle, as gas filters and particle filters as well as combination filters, which can filter out gases and particles.

The volume flow of filtered air is made available to the user in the area of the face by means of the breathing mask. The breathing mask may be placed or carried at or on the head of the user. The volume flow of filtered air is delivered from the blower filter device to the breathing mask through a tube preferably associated with the blower filter system. The tube may consequently extend from the blower filter device to the breathing mask. The blower filter device preferably has for this a device tube port, to which one end of the tube can be detachably connected. It is preferably a quick port connection. Tube connections as well as correspondingly designed ends of tubes are known from the state of the art. The other end of the tube can preferably be connected detachably to a mask tube port. The mask tube port may have a design analogous to that of the device tube port. Consequently, should, for example, replacement and/or maintenance of the breathing mask, the tube and/or the blower filter device become necessary, the other components may continue to be used for the time being.

In addition, a carrying system, which can be connected to a carrying system mount of the blower filter device especially in a detachable manner, is provided for the blower filter system. The blower filter device and/or the blower filter system as a whole can thus be designed as a portable unit. The user, who would like to move with such a blower filter system in a mobile manner, can carry the blower filter device on his body by means of the carrying system, designed, for example, as a hip belt. The breathing mask can be attached to the head of the user or can be placed on the head, so that the breathing mask can be carried by the head of the user. The tube extends from the blower filter device to the breathing mask, so that the tube can be carried at least partly by the blower filter device and the breathing mask.

In addition, a central control unit, which controls the motor of the blower and/or can process inputs of the user, may be provided for the blower filter device.

Reliable function of the blower filter system is of vital importance for the user of the blower filter system. Should, therefore, for example, the state of charge of the battery, the filtering ability of the air filter or another state of the blower filter system, especially of the blower filter device, change such that it is relevant or even critical for the user, it proved to be advantageous to provide the user of the blower filter device or of the blower filter system with important information. One way of providing the user with relevant and/or critical information is to send a corresponding signal on a display of the blower filter device. However, the blower filter device is usually carried by means of the carrying system on the back of the user. Therefore, there is a risk during use that the user does not sufficiently observe the display, so that the aforementioned information fails to reach the user. Another possibility of transmitting said information is to provide a sound emission unit, especially a loudspeaker, wherein the sound emission unit is preferably associated with the blower filter device. Should the blower filter device and/or another component of the blower filter system assume a certain state or a critical state, an acoustic signal can be emitted by the sound emission unit. The acoustic signal propagates in the area surrounding the user. The user can perceive the corresponding signal by means of his ears in order to then respond to it correspondingly. In particular, the user can then look at the display of the blower filter device to obtain detailed information.

However, it may happen, depending on the conditions of use, that the user is in an area in which the noise level is very high. Therefore, there is a risk that the user does not perceive the acoustic signals of the sound emission unit as a consequence of the high noise level. This problem can be solved by the volume or the sound level of the sound emission unit being markedly increased. It is necessary in this connection for the sound level that is emitted by the sound emission unit to be selected such that it is markedly higher than the sound level of the noise level. The user of the blower filter system can then perceive the acoustic signal of the sound emission unit in order to be informed of a relevant and/or dangerous situation or a relevant or dangerous state of the blower filter system. However, problems have been encountered in practice in connection with the use of a blower filter system with sound emission units having especially high volumes, because blower filter systems are usually used by a group of a plurality of users, who carry a blower filter system each. If a relevant or dangerous state develops in one of the blower filter systems, upon which the corresponding blower filter system sends a warning signal by means of the sound emission unit, the majority of the users of the aforementioned group are unable to recognize the particular blower filter system by which the warning signal is being emitted.

SUMMARY OF THE INVENTION

An object of the present invention is therefore to perfect the blower filter system mentioned in the introduction in such a manner that the user of the blower filter system can perceive a warning signal emitted by the sound emission unit in an identifiable manner even in environmental situations with high noise level.

According to a first aspect, the aforementioned object is accomplished by a blower filter system which has a blower filter device with a housing, an air inlet, an air outlet and an air duct extending between the air inlet and the air outlet in the housing. A blower associated with the air duct delivers air from the air inlet to the air outlet. An air filter, a carrying system, which can be connected to the blower filter device, a breathing mask, a tube, which extends from the air outlet to the breathing mask, and a sound emission unit, which is associated with the blower filter device are also provided. A wall section of the air duct is formed by an acoustic membrane for coupling sound into the air duct, and the sound emission unit is arranged in the housing of the blower filter device.

The air duct is designed to guide and/or direct air between the inlet duct and the outlet duct. The acoustic membrane is preferably airtight. The acoustic membrane is designed to introduce a sound into the interior space of the air duct. The acoustic membrane is acoustic transmission region of the air duct and acoustic damping (acoustic damping characteristics) of the acoustic membrane is preferably markedly lower than the acoustic damping (acoustic damping characteristics) of the rest of the air duct. If a sound is introduced into the air duct by means of the acoustic membrane, the sound propagates in the rest of the air duct in the direction of flow of the air stream being delivered by the blower. Based on the high damping (soundproofing) of the walls of the rest of the air duct, the sound will not extensively exit the air duct. To couple a corresponding sound or an acoustic signal into the air duct by means of the acoustic membrane, the sound emission unit of the blower filter system is arranged in the housing of the blower filter device. The acoustic membrane and the sound emission unit are thus arranged in the housing of the blower filter device, because the air duct, which is formed in some sections by the acoustic membrane, extends in the housing between the air inlet and the air outlet. If a state of the blower filter system, especially of the blower filter device, which causes a warning signal by means of the sound emission unit, develops, the warning signal emitted by the sound emission unit is coupled into the air duct by means of the acoustic membrane. With the warning signal being coupled into the air duct, the warning signal is directed with the air stream to the breathing mask, which is located at or on the head of the user. The tube may be designed to direct a sound signal. This may be brought about, for example, by corresponding tube walls. The warning signal exits at the breathing mask. The warning signal then reaches, especially indirectly, the ears or the hearing of the user. It is therefore not necessary for the sound emission unit to send the warning signal with such a high sound level that it is also audible by users located in the vicinity. The warning signal can rather be emitted with a markedly lower volume, because the warning signal is transported through the air duct to the breathing mask, and therefore especially into the immediate vicinity of the ear of the user. The user can thus recognizably perceive the warning signal. A user located in the vicinity will hardly perceive the warning signal if at all because of a damping by the path between the breathing mask of the user and the ear of the user located in the vicinity. Should the user located in the vicinity nevertheless perceive the warning signal, the warning signal will have a markedly lower volume. The user located in the vicinity can immediately recognize from this that the warning signal was not generated by the blower filter system that is being carried by that particular user. In other words, the users of blower filter systems according to the present invention can immediately identify whether the particular blower filter system being carried by them is sending a warning signal by means of the sound emission unit or whether a warning signal from a user located in the vicinity is being perceived.

An advantageous embodiment of the blower filter system is characterized in that the acoustic membrane is airtight and/or gastight. This is especially advantageous if the acoustic membrane forms a wall section of the air duct that is arranged between the blower and the air outlet. The pressure in the interior space of the air duct is greater in this area than in the area surrounding the blower filter system. It is therefore guaranteed with the airtight and/or gastight design of the acoustic membrane that the acoustic membrane does not cause a pressure drop. The air being delivered by the blower is rather also guided and/or directed by the acoustic membrane. If the acoustic membrane forms a wall section of the air duct between the air inlet and the blower, it may likewise be advantageous if the acoustic membrane is airtight and/or gastight. This is especially true if an air filter is arranged at the air inlet. Air freed from harmful substances will then flow into the air duct through the air inlet when the blower is activated. In order not to draw in any secondary air, especially secondary air containing harmful substances, through the acoustic membrane, the acoustic membrane is preferably airtight and/or gastight. This ensures that only filtered air will reach the breathing mask.

Another advantageous embodiment of the blower filter system is characterized in that the acoustic membrane is arranged between the blower and the air outlet. It was determined in practice that a warning signal, if it must pass through the region of the blower, on the way to the breathing mask, is damped by the blower. It therefore proved to be advantageous to arrange the acoustic membrane behind (downstream of) the blower. The sound pressure of the sound emission unit can be reduced in this manner without the user perceiving a lower volume of the warning signal emitted by the sound emission unit. In other words, the acoustic resistance between the sound emission unit and the ear of the user or the breathing mask is lower when the acoustic membrane is arranged between the blower and the air outlet.

Another advantageous embodiment of the blower filter system is characterized in that the sound emission unit is located at a spaced location from the acoustic membrane. As was mentioned in the introduction, the blower filter device is carried by the user. A hip belt, to which the blower filter device can be attached, is usually provided for this. To make wearing comfort as good as possible, compact designs are desirable for the blower filter device. It proved to be advantageous in this connection for the compact design of the blower filter device if the acoustic membrane and the sound emission unit are located at spaced locations from one another. The space available for installing the blower filter device can be used in an especially flexible manner in this case in order to accommodate the necessary elements in the housing of the blower filter device.

Another advantageous embodiment of the blower filter system is characterized in that a principal radiation direction of the sound emission unit is directed into the interior space of the housing of the blower filter device. This guarantees that the warning signal emitted by the sound emission unit reaches the acoustic membrane with the lowest possible damping in order to be coupled by this into the air duct. Should the principal radiation direction of the sound emission unit not be directed, for example, into the interior space of the housing but, for example, to an adjacent outer wall of the housing, the sound emitted by the sound emission unit is to be reflected first on the outer wall before this sound reaches the sound emission unit. The consequence of this is usually a greater damping of the emitted sound, which reduces the sound pressure level of the reflected sound signal. The sound pressure level of a warning signal emitted by means of the sound emission unit could thus be increased. However, this is considered to be disadvantageous, because part of the warning signal is also transmitted by the outer wall of the housing to the surrounding area, and it thus contributes to the increase in the noise level in the surrounding area. However, this is preferably to be avoided. An especially preferred embodiment is characterized in that the principal radiation direction points towards the acoustic membrane. As an alternative, provisions may be made for the principal radiation direction to be directed towards the acoustic membrane in such a manner that the principal radiation direction is at an angle of between 1° and 60° in relation to the normal to the acoustic membrane.

Another advantageous embodiment of the blower filter system is characterized in that a control unit, which controls the sound emission unit, is associated with the blower filter system and especially the blower filter device. The control unit may be designed to also control the blower filter device and/or the blower filter system. Thus, the control unit may control, for example, the blower. Due to the sound emission unit being associated with the control unit, the control unit and the sound emission unit may be designed and/or manufactured as a common unit. In particular, the control unit has a board, on which the sound emission unit is fastened. The sound emission unit is associated with an assembly unit forming the control unit in this case. Such a design can be manufactured in an especially simple and cost-effective manner.

Another advantageous embodiment of the blower filter system is characterized in that the sound emission unit forms an integral part of the control unit. The sound emission unit may be permanently connected to the other parts of the control unit in this case. Thus, the sound emission unit may be designed, for example, as a loudspeaker. The loudspeaker or the sound emission unit may then have a permanent mechanical and/or electrical connection to the other parts of the control unit.

Another advantageous embodiment of the blower filter system is characterized in that the acoustic membrane forms a resonator, which has a natural frequency between 2 kHz and 4 kHz, with the air duct. It was determined in practice that warning signals sent by the sound emission unit are perceived especially well as warning signals in the range of 2 kHz to 4 kHz. It is therefore desirable for the frequency spectrum between 2 kHz and 4 kHz to be transmitted to the breathing mask and thus to the user's ear with the lowest possible damping. Due to the acoustic membrane forming a resonator with the air duct, which resonator has a natural frequency between 2 kHz and 4 kHz, it can be guaranteed in an especially simple manner that frequencies between 2 kHz and 4 kHz will travel over the desired transmission path as best as possible, i.e., with a low damping.

Another advantageous embodiment of the blower filter system is characterized in that a signal frequency of the sound emission unit corresponds to a natural frequency of the acoustic membrane and/or of the resonator. By adapting the signal frequency to the natural frequency of the acoustic membrane, it can be ensured in an especially simple manner that the signal frequency will be coupled into the air duct. An especially low transmission damping is guaranteed from the acoustic membrane to the breathing mask by the signal frequency being tuned to the natural frequency of the resonator.

Another advantageous embodiment of the blower filter system is characterized in that the air duct is made airtight at least between the blower housing and the air outlet. Reference is made in this connection to the above-mentioned advantages and effects.

Another advantageous embodiment of the blower filter system is characterized in that the acoustic membrane is a PTFE membrane or a stainless steel membrane. Both membranes are characterized by their high resistance to chemicals. In addition, such membranes may have an especially small wall thickness, for example, between 30 μm, and 500 μm, and especially between 30 μm and 100 μm.

Another advantageous embodiment of the blower filter system is characterized in that a wall of the air duct has a ring-shaped membrane seating (defines a seat), by which the acoustic membrane is clamped. The necessary dimensional stability to clamp the acoustic membrane is guaranteed with the ring-shaped membrane seating. The acoustic membrane preferably has a diameter between 10 mm and 50 mm, especially preferably between 15 mm and 35 mm, and especially 20 mm or 28 mm. The natural frequency of the resonator formed by the air duct and the acoustic membrane can be determined by a preferred combination of the aforementioned thickness of the acoustic membrane and a preferred diameter of the acoustic membrane. The preferred and advantageous transmission properties of sound waves are thus guaranteed in order to transmit a warning signal from the sound emission unit to the breathing mask and to the ear of the user.

The present invention will be described below without limitation of the general inventive idea on the basis of exemplary embodiments with reference to the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
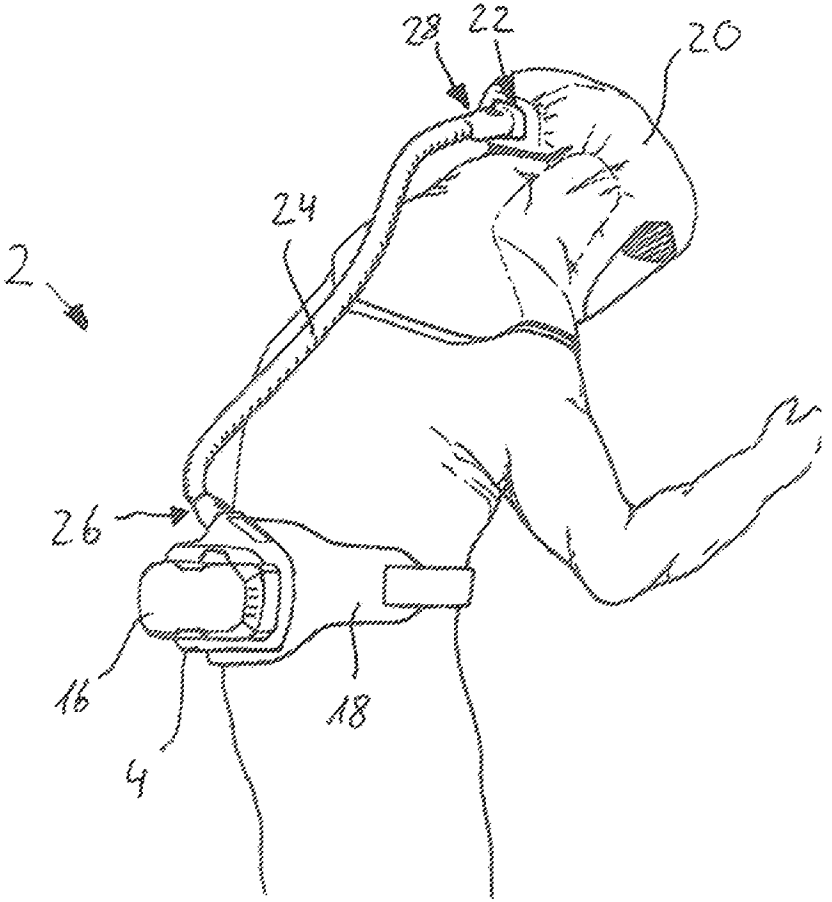
FIG. 1 is a schematic perspective view of the blower filter system, which is carried by a user.
Figure 2:
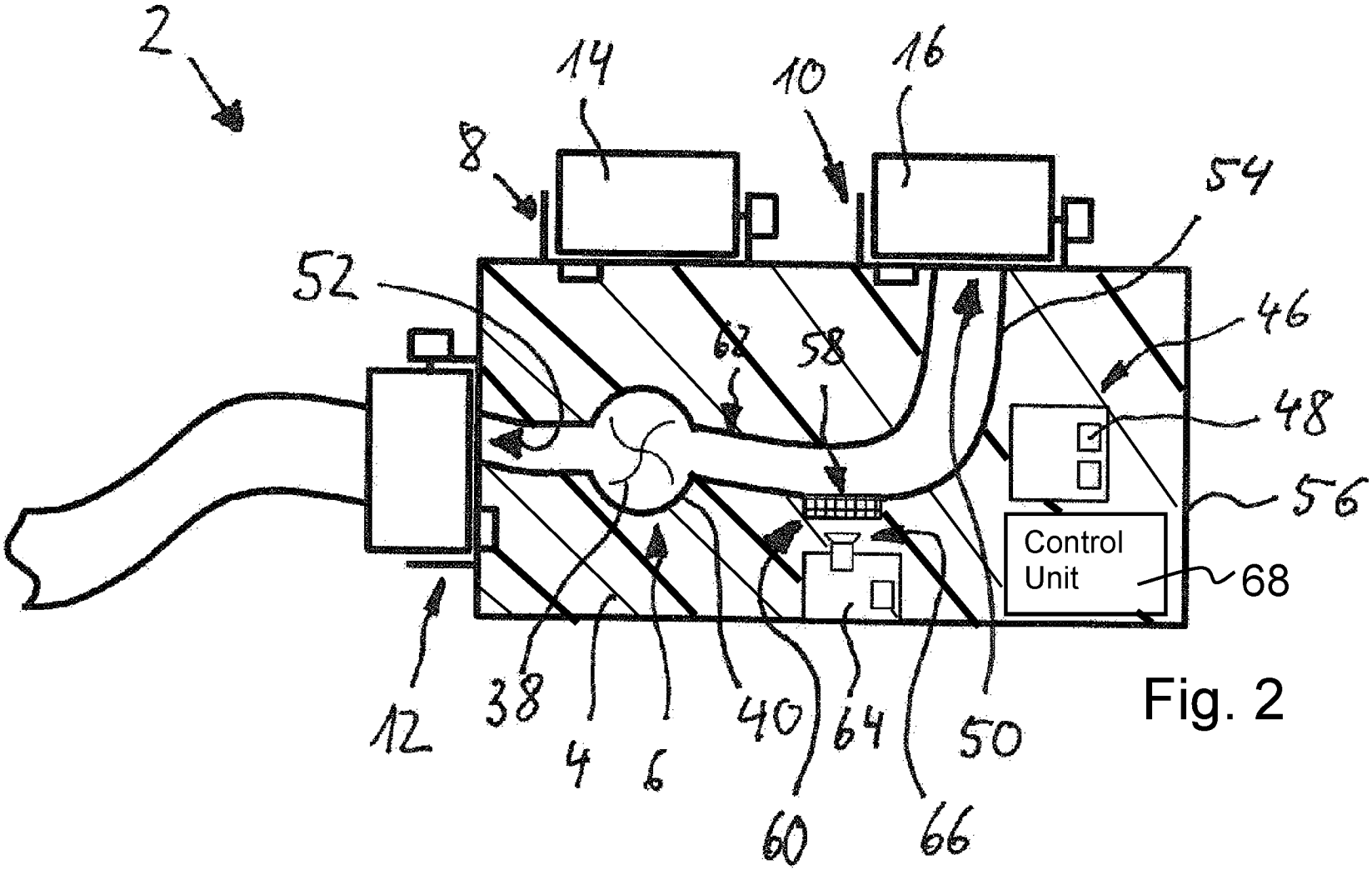
FIG. 2 is a detail of a schematic cross-sectional view of the blower filter system.

Referring to the drawings, FIG. 1 shows a blower filter system 2, which is carried by a person. The blower filter system 2 preferably comprises a plurality of components. The components are, for example, a blower filter device 4, an input unit 46 with a button 48, a battery 14, an air filter 16, a carrying system 18, a breathing mask 20 and/or a tube 24. A volume flow of air is generated by means of the blower filter device 4. Viewing together with FIG. 2 shows that the blower filter device 4 has a blower 6. The blower 6 preferably comprises a motor, a fan impeller 38 driven by the motor and a corresponding blower housing 40, especially a spiral housing. The motor of the blower 6 is usually an electric motor. The energy needed to generate the volume flow of air is made available by the electric battery 14. Based on the finite storage capacity of electric energy in the battery 14, the battery 14 is replaceable. The blower filter device 4 has a battery mount 8 for this, into which the battery 14 can be inserted and in which it can then be secured.

To control and/or regulate the blower 6, a control unit 68, is provided for the blower filter device 4. The output of the blower 6 and hence also the volume flow of air made available by the blower filter device 6 can be set with the control unit 68. Ambient air is drawn in with the blower filter device 4. The blower filter device 4 has an air inlet 50 for this. As is shown in FIG. 2, a filter mount 10 may adjoin the air inlet 50 and/or form an integral part of the air inlet 50. The air filter 16 is inserted into the filter mount 10 and/or it is fastened to the filter mount. Before the ambient air reaches the blower 6, this is freed from harmful substances by the air filter. The volume flow of air generated by the blower 6 or the blower filter device 4 leaves the blower filter device 4 at the air outlet 52. An air duct 54 associated with the blower filter device 4 extends between the air inlet 50 and the air outlet 52. The air duct 54 is arranged in a housing 56 of the blower filter device 4 here. As can be seen from FIG. 2, the blower 6 is associated with the air duct 54. Together with the rest of the air duct 54, the blower housing 40 forms a space that is airtight with the exception of the air inlet 50 and the air outlet 52. The filtered ambient air drawn in from the air inlet 50 is delivered to the air outlet 52 by means of the fan impeller 38 driven by the motor. A device tube port 12 is arranged at the air outlet 52 and/or it is integrated in the air outlet 52. A first end 26 of the tube 24 can be detachably connected to the device tube port 12. The tube 24 is connected by its second tube end 28 to a mask tube port 22 of the breathing mask 20, so that the air being delivered by the blower 6 flows into the breathing mask 20 and is made available to the user in the area of the head, especially the face.

FIG. 1 shows that the breathing mask 20 may also be a mask hood. To ensure that warning signals will reach the user in as targeted a manner as possible even in an area subject to noise pollution, without irritating and/or frightening other users located in the area with the warning signal sent, provisions are made for a wall section 58 of the air duct 54 to be formed by an acoustic membrane 60 for coupling sound into the air duct 54. Provisions are made, in principle, for the duct wall 62 of the air duct 54 to be airtight and/or gastight. An unintended exchange of air between the interior space of the air duct 54 and the area surrounding the air duct 54 is effectively prevented from occurring. The wall section 58 is preferably defined as a section of the duct wall 62, and the wall section may occupy, for example, an area of the duct wall ranging from 1.5 $cm^2$ to 10 $cm^2$. To receive the acoustic membrane 60, the duct wall 62 may have a mount that is designed for fastening the acoustic membrane 60 in the area of the wall section 58. A sound, especially a warning signal, can be coupled into the interior space of the air duct 54 by means of the acoustic membrane 60. If this has happened, the sound and especially the warning signal is directed by the air duct. The sound or the warning signal consequently reaches the air outlet 52, and it is transmitted to the tube there. The sound or the warning signal will reach from this the breathing mask 20, so that the sound or the warning signal is directed to the head and/or the ears of the user. It is no longer necessary with the above-mentioned guiding of the sound or of the warning signal for the sound or the warning signal to have a very high volume or a high sound level. It is rather achieved by the air duct 54 with the acoustic membrane 60, the tube 24 and the breathing mask 20 that only a relatively faint sound or a relatively faint warning signal is necessary for it to be perceived by the user. To generate the sound to be coupled or the warning signal to be coupled, a sound emission unit 64 is arranged in the housing 56 of the blower filter device 4. This sound emission unit 64 has, for example, a loudspeaker 66, which is directed towards the acoustic membrane 60. A sound emitted by the loudspeaker 66 or a warning signal emitted by the loudspeaker 66 will the reach the acoustic membrane 60 and is coupled into the air duct 54. The sound or the warning signal is then directed, as was mentioned above, to the ears of the user.

The blower filter system 2 explained above proved to be especially advantageous in extreme missions. Thus, it is occasionally necessary, for example, for the user of the blower filter system 2 to take a shower before the user ends the use of the blower filter system 2. The blower filter device 4 shall have at least a splash-proof design or a waterproof design in this case. The housing 56 shall have a splash-proof and/or waterproof design in this case. With the sound emission unit 64 being arranged in the housing 56 and with the acoustic membrane 60 being provided, it is possible to generate a warning signal within the housing 56 and to transport this to the ears of the user. Consequently, no separate opening, which would have to be sealed against water, is necessary in the housing for the sound emission unit 64.

It was, moreover, found in practice that sound emission units 64 are subject to a higher probability of failure if they are placed and/or used in a dusty environment. Due to the sound emission unit 64 being arranged within the housing 56 of the blower filter device 4, dust is effectively prevented from reaching the sound emission unit 64 from the area surrounding the blower filter device 4. The interior space of the housing 56 of the blower filter device 4 consequently has a dustproof, splash-proof and/or waterproof design. Even though the air inlet 50 and the air outlet 52 form openings in a wall of the housing 56, the air duct 54 extends between the air inlet 50 and the air outlet 52. Water or dust cannot therefore enter the interior space of the housing 56. The space occupied by the air duct 54 in the interior space of the housing 56 can be left out of consideration in this examination.

The sound emission unit 64 may be associated with a control unit 68 of the blower filter device 4 or form an integral part of a blower filter system control device. The control device is arranged in this case in the interior space of the housing 56 of the blower filter device 4. Such an embodiment has to be especially cost-effective and to be able to be mounted in a simple manner in practice, because the control unit with the sound emission unit 64 can be preassembled as one assembly unit in an especially simple manner. This lowers the costs and the time needed for mounting.

While specific embodiments of the invention have been shown and described in detail to illustrate the application of the principles of the invention, it will be understood that the invention may be embodied otherwise without departing from such principles.

APPENDIX

| List of Reference Numbers | |
|---|---|
| 2 | Blower filter system |
| 4 | Blower filter device |
| 6 | Blower |
| 8 | Battery mount |
| 10 | Filter mount |
| 12 | Device tube port |
| 14 | Battery |
| 16 | Air filter |
| 18 | Carrying system |
| 20 | Breathing mask |
| 22 | Mask tube port |
| 24 | Tube |
| 26 | First tube end |
| 28 | Second tube end |
| 34 | Sensor |
| 36 | Transition area |
| 38 | Fan impeller |
| 40 | Blower housing |
| 42 | Locking unit |
| 44 | Locking bar |
| 46 | Input unit |
| 48 | Button |
| 50 | Air inlet |
| 52 | Air outlet |
| 54 | Air duct |

APPENDIX-continued

| List of Reference Numbers | |
|---|---|
| 56 | Housing of the blower filter device |
| 58 | Wall section |
| 60 | Acoustic membrane |
| 62 | Duct wall |
| 64 | Sound emission unit |
| 66 | Loudspeaker |
| 68 | Control unit |

What is claimed is:

1. A blower filter system comprising:

a blower filter device comprising a housing, an air duct, at least one air inlet and at least one air outlet, wherein the at least one air inlet and the at least one air outlet form respective openings in the housing, and the air duct extending between the air inlet and the air outlet in the housing, the air duct comprising a circumferential outer surface;

a blower associated with the air duct for delivering air from the air inlet to the air outlet;

an air filter operatively connected to the air duct;

a carrying system connected to the blower filter device;

a breathing mask;

a tube extending from the air outlet to the breathing mask;

a sound emission unit associated with the blower filter device; and an acoustic membrane coupling sound from outside the air duct into the air duct, wherein a wall section of the air duct is formed by the acoustic membrane and the sound emission unit is arranged outside the air duct in the housing of the blower filter device, the sound emission unit being located at a spaced location from the acoustic membrane.

2. The blower filter system in accordance with claim 1, wherein the acoustic membrane is at least one of airtight and gastight, the air duct defining at least a portion of a fluid flow path, the sound emission unit being located at a spaced location from the fluid flow path.

3. The blower filter system in accordance with claim 1, wherein the acoustic membrane is arranged between the blower and the air outlet.

4. The blower filter system in accordance with claim 1, wherein a principal emission direction of the sound emission unit is directed into the interior space of the housing.

5. The blower filter system in accordance with claim 1, further comprising a control unit controlling the sound emission unit.

6. The blower filter system in accordance with claim 1, wherein the sound emission unit forms an integral part of the control unit.

7. The blower filter system in accordance with claim 1, wherein the acoustic membrane forms a resonator with the air duct, said resonator having a natural frequency between 2 kHz and 4 kHz.

8. The blower filter system in accordance with claim 1, wherein a signal frequency of the sound emission unit corresponds to a natural frequency of the acoustic membrane.

9. The blower filter system in accordance with claim 1, wherein the housing has an airtight design with the exception of the at least one air inlet and the at least one air outlet.

10. The blower filter system in accordance with claim 1, wherein the air duct has an airtight design at least between the housing and the air outlet, the sound emission unit being located at a spaced location from the air duct.

11. The blower filter system in accordance with claim 1, wherein the acoustic membrane is a PTFE membrane or a stainless steel membrane, the sound emission unit emitting the sound in a direction traversing a fluid flow path defined by the air duct.

12. The blower filter system in accordance with claim 1, wherein a wall of the air duct has a ring-shaped membrane seating, by which the acoustic membrane is clamped to the air duct.

13. A blower filter system comprising:

a blower filter device housing;

a gas duct extending between a filter device housing gas inlet and a filter device housing gas outlet, the gas duct comprising an acoustic transmission region and a remaining region wherein the acoustic transmission region has acoustic damping characteristics that are lower than acoustic damping characteristics of a remainder of the gas duct;

a blower operatively connected to the gas duct for delivering gas from the gas inlet to the gas outlet;

a gas filter operatively connected to the gas duct;

a carrying system connected to the blower filter device housing;

a breathing tube operatively connected to the gas outlet;

a breathing mask operatively connected to the breathing tube; and a sound emission unit in the blower filter device housing, the sound emission unit being located at a spaced location from the acoustic transmission region.

14. The blower filter system in accordance with claim 13, wherein:

the gas duct is gastight between the housing gas inlet and the housing gas outlet;

the blower filter device housing has at least one of a dustproof, splash-proof and/or waterproof design with the exception of the at least one gas inlet and the at least one gas outlet:

the gas duct defines at least a portion of a fluid flow path, the sound emission unit being located at a spaced location from the fluid flow path.

15. The blower filter system in accordance with claim 14, wherein the acoustic transmission region is arranged between the blower and the gas outlet the gas duct defines at least a portion of a fluid flow path, the sound emission unit emitting the sound in a direction traversing the fluid flow path.

16. The blower filter system in accordance with claim 14, wherein:

the sound emission unit is located adjacent to the acoustic transmission region;

a principal emission direction of the sound emission unit is directed into the interior space of the housing.

17. The blower filter system in accordance with claim 14, further comprising a control unit controlling the sound emission unit, wherein the sound emission unit forms an integral part of the control unit.

18. The blower filter system in accordance with claim 13, wherein the acoustic transmission region is defined by an acoustic membrane that forms a resonator with the remainder of the gas duct, said resonator having a natural frequency between 2 kHz and 4 kHz.

19. The blower filter system in accordance with claim 13, wherein:

the acoustic transmission region is defined by an acoustic membrane, the acoustic membrane coupling the sound from outside the gas duct into the gas duct;

the gas duct defines at least a portion of a fluid flow path;

the sound emission unit is located at a spaced location from the fluid flow path; and a signal frequency of the sound emission unit corresponds to a natural frequency of the acoustic membrane.

* * * * *